United States Patent [19]

Kokubo et al.

[11] Patent Number: 4,880,480

[45] Date of Patent: Nov. 14, 1989

[54] HIGH STRENGTH HOT ROLLED STEEL SHEET FOR WHEEL RIMS

[75] Inventors: Ichiro Kokubo, Hyogo; Kazuhiko Kourida; Shunichi Hashimoto, both of Kobe; Kazuhiro Mimura, Hyogo; Zenichi Shibata, Kobe, all of Japan

[73] Assignee: Kabushiki Kaisha Kobe Seiko Sho, Kobe, Japan

[21] Appl. No.: 87,967

[22] Filed: Aug. 17, 1987

Related U.S. Application Data

[63] Continuation of Ser. No. 822,485, Jan. 24, 1986, abandoned.

[30] Foreign Application Priority Data

Jan. 24, 1985 [JP] Japan ..... 60-11198
May 13, 1985 [JP] Japan ..... 60-101790
May 13, 1985 [JP] Japan ..... 60-101789

[51] Int. Cl.[4] ..... C22C 38/14
[52] U.S. Cl. ..... 148/320; 148/331
[58] Field of Search ..... 420/126, 127, 128; 148/320, 331

[56] References Cited

U.S. PATENT DOCUMENTS 4,042,273 8/1977 Heller et al. ..... 148/36
4,105,474 8/1978 Nakasugi et al. ..... 148/12 F
4,184,898 1/1980 Ouchi et al. ..... 148/36
4,388,122 6/1983 Sudo et al. ..... 148/12 F

FOREIGN PATENT DOCUMENTS 3012139 10/1980 Fed. Rep. of Germany ..... 148/36

*Primary Examiner*—Deborah Yee
*Attorney, Agent, or Firm*—Oblon, Spivak, McClelland, Maier & Neustadt

[57] ABSTRACT

A high strength hot rolled steel sheet for wheel rims contains, by weight, from 0.05 to 0.15% of C, from 0.05 to 0.5% of Si, from 1.0 to 1.6% of Mn, from 0.01 to 0.05% of Al, from 0.005 to 0.025% of Ti and from 15 to 60 ppm of N, with the content of P limited to 0.030% or below and the content of S limited to 0.010% or below, the balance being iron and unavoidable impurities. The steel sheet optionally contains, by weight, from 0.01 to 0.06% of Nb or at least one selected from the group consisting of from 0.0005 to 0.01% of Ca and from 0.005 to 0.1% of rare earth metals.

3 Claims, 6 Drawing Sheets

HIGH STRENGTH HOT ROLLED STEEL SHEET FOR WHEEL RIMS

This application is a continuation of application Ser. No. 06/822,485, filed on Jan. 24, 1986, now abandoned.

BACKGROUND OF THE INVENTION

1. Field of the Invention

The present invention relates to a high strength hot rolled steel sheet for wheel rims, and more particularly to a high strength hot rolled steel sheet for wheel rims which is excellent in DC weldability and formability.

2. Discussion of the Background

As a measure to reduce the weight of automobile bodies for saving fuel costs, there has been an attempt to modify the material for the automobile bodies by employment of high strength hot rolled steels, coupled with an attempt to reduce the size of automobile bodies. In particular, a reduction in the weight of wheels has been deemed effective in curtailing the fuel costs, and extensive studies have been made on the application of high strength steel sheets to wheel rims.

Wheel rims have hitherto been produced by cutting a steel sheet to predetermined width and length, forming the cut sheet piece into a ring form and welding the ends thereof to each other, followed by several steps of roll forming. For the welding, the technique of flash butt welding has hitherto been employed; but, in recent years, there is a trend toward the adoption of DC butt welding for this purpose in view of its merits that the welding environment is not worsened by dusts or noise, because of the absence of flashing, and about 1% increase in the yield can be expected because no part of the material is consumed in flashing.

However, the use of DC butt welding encounters a new problem in the production of the wheel rims. Namely, a situation which has mattered little in the conventional use of steel sheets with a tensile strength of not higher than 45 kgf/mm$^2$ comes to be a problem in the case of using high strength steel sheets with a higher C or Mn content. The problem, is that due to the large-current welding or the welding condition wherein an electric current is passed during the upset process or even after the upset process, austenite grains in the steel are coarsened by the time of completion of welding, which lead to high hardenability in the subsequent cooling process, and accordingly, the austenite is likely to be transformed into martensite or hard bainite, resulting in an extremely high hardness of the weld zone. Consequently, cracking tends to occur starting from the welded interface during the subsequent working. Although the limit of the maximum hardness of the weld zone has not hitherto been made clear, it has been found by the present inventors' studies that the upper limit of the maximum hardness is preferably about 300. However, in most cases where conventional high tensile steels are welded by DC butt welding, the maximum hardness (Hv) of the weld zone exceeds 300, which is higher than those of flash butt welded steels by at least 100, and the structure of the DC butt welded steel is nearly martensite. Furthermore, brittle rupture surfaces are present in the weld zone, and the Charpy absorption energy ($vE_0$) at 0° C. is low.

SUMMARY OF THE INVENTION

It is an object of the present invention to provide a high strength hot rolled steel sheet for wheel rims which overcomes the abovementioned drawbacks of the conventional high strength hot rolled steel sheets for wheel rims, particularly, the problem of the high hardness of the DC butt welded zone arising from the larger amount of electric current passed during DC butt welding as compared to the case of flash butt welding.

The present invention provide a high strength hot rolled steel for wheel rims, containing, by weight, from 0.05 to 0.15% of C, from 0.05 to 0.5% of Si, from 1.0 to 1.6% of Mn, from 0.01 to 0.05% of Al, from 0.005 to 0.025% of Ti and from 15 to 60 ppm of N, with the content of P limited to 0.030% or below and the content of S limited to 0.010% or below, the balance being iron and unavoidable impurities.

Other and further objects, features and advantages of the present invention will appear more fully from the following description and appended claims, taken in conjunction with the accompanying drawings.

DETAILED DESCRIPTION OF THE PREFERRED EMBODIMENTS

Figure 1:
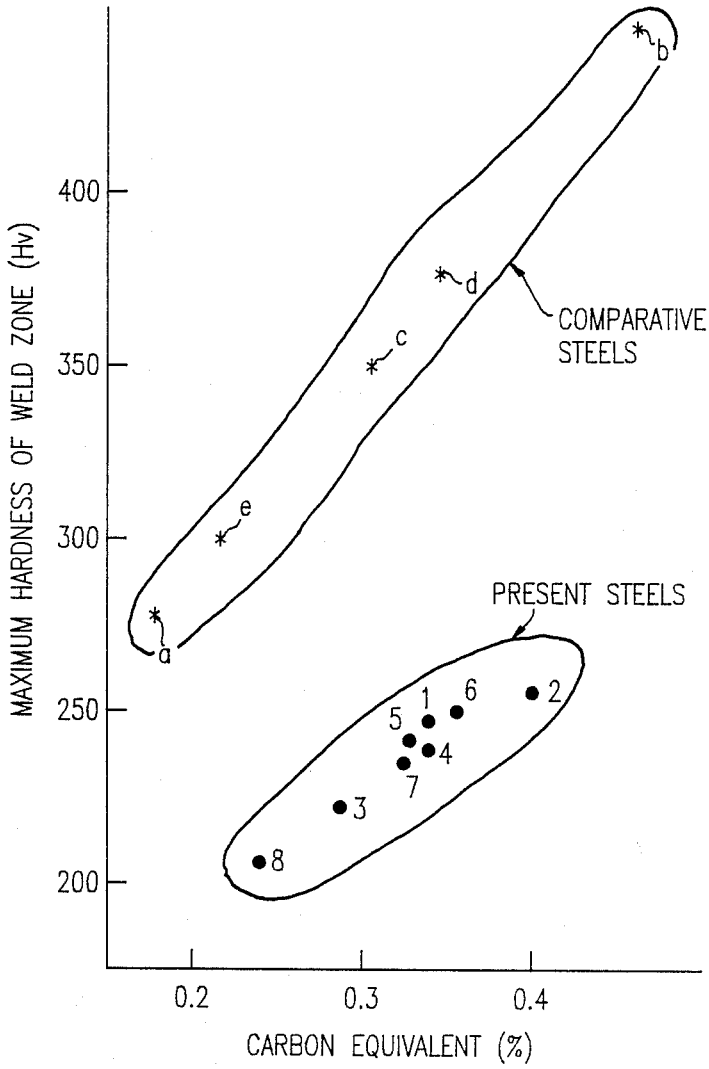
FIGS. 1 and 4 are graphs showing the relationship between carbon equivalent and the maximum hardness (Hv) of DC butt welded zone, for the steels of the present invention and comparative steels.

The high strength hot rolled steel sheet for wheel rims according to the present invention contains, by weight, from 0.05 to 0.15% of C, from 0.05 to 0.5% of Si, from 1.0 to 1.6% of Mn, from 0.01 to 0.05% of Al, from 0.005 to 0.025% of Ti and from 15 to 60 ppm of N, with the content of P limited to 0.030% or below and the content of S limited to 0.010% or below, the balance being iron and unavoidable impurities.

The contents of the chemical components in the present steel are limited as above for the reasons as follows.

C is an element necesasry for imparting a desired strength to the steel, and should be added in an amount of at least 0.05%. However, since DC butt welding has a characteristic of raising the hardness of the weld zone, addition of an excess of C is undesirable. Thus, in the present steel, the upper limit of the carbon content is 0.15%.

Si has an effect on the penetrator formed at the butt interface in the welding process, and in order to prevent the formation of the penetrator, Si is added in an amount of from 0.05 to 0.5%. When the Si content is out of the limits, penetrator is formed.

Mn is necessary for enhancing the strength of the steel. In order to obtian a high strength steel sheet having a tensile strength of not lower than 50 kgf/mm$^2$, Mn should be added in an amount of not less than 1.0%. However, when Mn is added in excess, the second phase tends to be arranged in layres to form the so-called banded structure, resulting in degradation of ductility, particularly in the width direction or the thickness direction of the steel sheet. Thus, the upper limit of Mn content is 1.6%.

P, when added in an excess amount, deteriorates the weld zone. Therefore, the P content is limited to 0.03% or below.

S will increase the amount of elongated MnS and cause cracking along the metal flow. Therefore, the S content should be as low as possible; practically, however, it suffices to limit the S content to 0.01% or below.

Al should be added in an amount of not less than 0.01%, for deoxidation of the steel. However, an addition of excess Al increases the amount of alumina base inclusions, thereby causing hooked cracking, like MnS. Therefore, the upper limit of Al content is 0.05%.

Ti is an essential element for lowering the hardness of the weld zone. To securely achieve this effect through dispersing fine TiN particles in an amount as large as possible, Ti should be added in an amount of not less than 0.005%. But, on the other hand, an addition of excess Ti causes coarsening of the TiN particles and reduces the number of TiN particles, thereby reducing the above effect on lowering the hardness of the weld zone by refining. Thus, the upper limit of Ti content is 0.025%.

N, when dispersed as fine TiN particles, serves as nucleation sites for ferrite grains, thereby inhibiting the formation of hard martensite or bainite. Namely, N is effective in preventing the rise in hardness. If the N content is less than 15 ppm, the amount of TiN formed is insufficient, and the above effect cannot be achieved securely. On the other hand, if the N content exceeds 60 ppm, ductility and aging properties of the steel are degraded. Therefore, in the present steel, the N content is from 15 to 60 ppm.

In the present steel, Nb may be added, in addition to the abovementioned elements. Nb is an element which enhances the strength of the steel through precipitation hardening, and in order to securely develop this effect, Nb should be added in an amount of at least 0.01%. Although the strengthening effect is proportional to the amount of Nb, an addition of excess Nb results in degradation in ductility of the parent metal. Thus, the upper limit of Nb content is 0.06%.

Further, in the present steel, at least one member selected from the group consisting of Ca and rare earth metals (REM) may be added, together with or separately from Nb. These elements are effective in spherodizing the elongated MnS particles, thereby preventing the hooked cracking. To securely achieve such an effect, not less than 0.0005% of Ca and/or not less then 0.005% of REM should be added. However, the effect is saturated as the amount of these elements increases, and an addition of an excess of these elements causes formation of the penetrator at the weld zone, with the result that cracking is likely to occur starting from the penetrator. Therefore, the upper limits of Ca and REM contents are 0.01% and 0.1%, respectively.

Next, the carbon equivalent ($Ceq=C+Si/24+Mn/6$) of the present steel containing the abovementioned components is desirably controlled to 0.25 to 0.34%. The present inventors have found that when producing a wheel rim from a steel sheet by DC butt welding, there is an intimate relationship between Ceq of the steel and the maximum hardness of the weld zone. Namely, as seen from FIG. 4 which shows the relationship between Ceq and the maximum hardness of the weld zone, when the Ceq exceeds 0.34%, the maximum hardness exceeds Hv 300. The rejection ratio in forming a wheel rim from the steel sheet decreases with a decrease in the maximum hardness of the weld zone. Concerning 60 kgf/mm$^2$ grade or 55 kgf/mm$^2$ grade high strength steels, however, a decrease in Ceq renders it necessary for retaining strength to add Nb and/or Ti in a large amount or to introduce martensite into the steel structure by coiling the rolled steel sheet at an extremely low temperature. But, on the other hand, the addition of a large amount of Nb and/or Ti leads to insufficient total elongation, and the introduction of martensite leads to a lowering in the hardness of the portion effected by the welding heat, causing a reduction in the plate thickness at that portion; in either case, the rejection ratio is again increased with the result of an increase in the production cost. Accordingly, in the present steel, Ceq is set to be not lower than 0.24%, and Nb and Ti contents are set to be not higher than 0.06% and not higher than 0.08%, respectively, thereby ensuring a total elongation of not less than 23%.

Thus by controlling Ceq to within the range of 0.28 to 0.34% thereby providing a ferrite-bainite, ferrite-bainite-pearlite or ferrite-pearlite structure, it is possible to secure a total elongation of not less than 23%.

As has been described above, since the present steel contains a minor amount of Ti together with N in an amount in a specified range, coarsening of austenite grains at the time of welding is prevented, and since finely dispersed TiN particles serve as nucleation sites for ferrite grains, formation of hard martensite or bainite is restrained, and, therefore, a rise in the hardness of th weld zone is effectively prevented. Accordingly, when the present steel is used for producing wheel rims by DC butt welding, the maximum hardness of the weld zone is markedly decreased as compared to the case of comparative steels having the same Ceq value a that of the present steel. A high $vE_0$ value comparable to those of flash butt welded steel sheets can also be obtained. Furthermore, by controlling Ceq to within the range of from 0.25 to 0.34%, a high strength hot rolled steel sheet for DC butt welding can be obtained which shows a maximum hardness of the weld zone of not higher than Hv 300 and a total elongation of the parent metal of not less than 23%.

The present invention will now be described more specifically while referring to the following nonlimitative examples.

EXAMPLE 1

Steels having the chemical compositions given in Table 1 were melted, and steel sheets having a thickness of 2.6 mm were formed by hot rolling on a laboratory scale and grinding both sides of the rolled sheets. Each of the steel sheets thus obtained was welded by DC butt welding or flash butt welding, and the hardness of the weld zone was measured. Separately, Charpy impact test was carried out at 0° C. using JIS No. 4 Sharpy test piece 2.5 mm wide. The results are shown in Table 1, FIG. 1 and FIG. 2.

Figure 2:
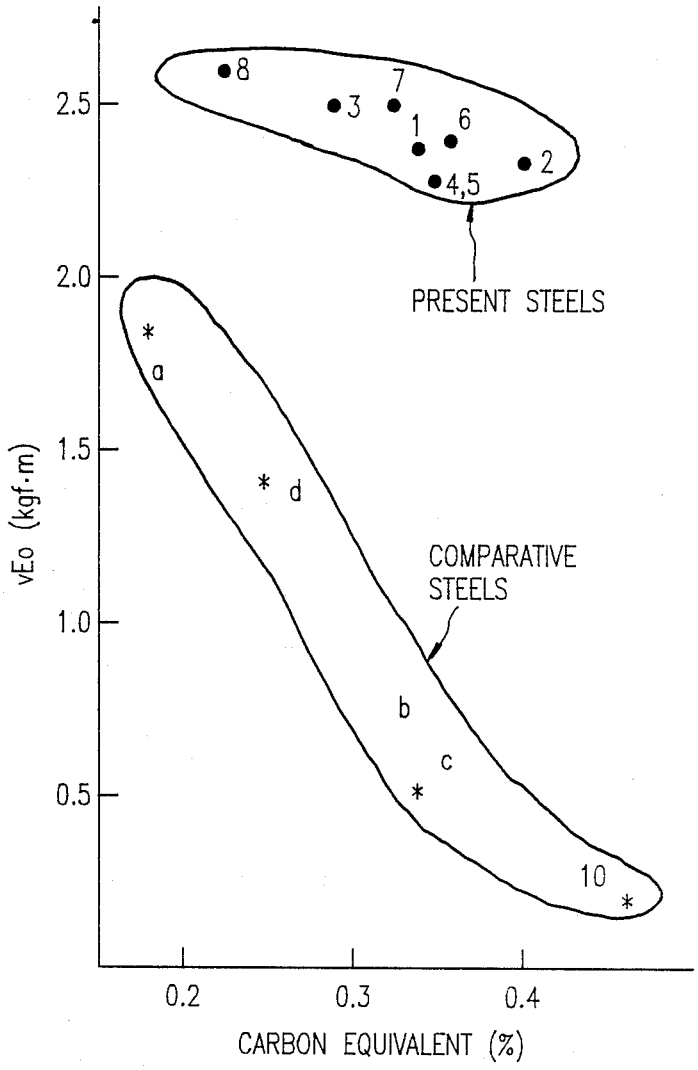
FIG. 2 is a graph showing the Charpy absorption energy ($vE_0$) at 0° C. of steels of the present invention and comparative steels.

FIG. 1 shows the relationship between Ceq and the maximum hardness (Hv) of the DC butt welded zone. The figure shows that most of comparative steels have a maximum hardness in excess of 300. Although the maximum hardness of the weld zone can be reduced to some extent by decreasing Ceq, as in comparative steels 9 and 13, a marked reduction in the maximum hardness can be achieved only upon the addition of a minor amount of Ti. FIG. 2 shows the charpy absorption energy ($vE_0$) at 0° C., and it shows that DC butt welded steel sheets with a high maximum hardness has an extremely low $vE_0$ value because of the presence of brittle rupture surfaces.

Thus, with the present steel, the maximum hardness of the weld zone can be markedly reduced as compared to the case of comparative steels having the same Ceq value as that of the present steel, and a high $vE_0$ value comparable to those of flash butt welded steel sheets can be obtained.

EXAMPLE 2

Steels having the chemical compositions given in Table 2 were melted in a converter, and steel sheets having a thickness of 2.6 mm were produced according to the usual industrial steel-making process. Hot rolling was conducted with a finishing temperature of 850° to 930° C., followed by coiling at a temperature of 450° to 650° C. Cooling after rolling was conducted through air cooling from a temperature of about 700° C. for 5 to 10 sec, depending on the chemical composition, and controlled rapid cooling was also conducted before and after the above mentioned air cooling.

Figure 3:
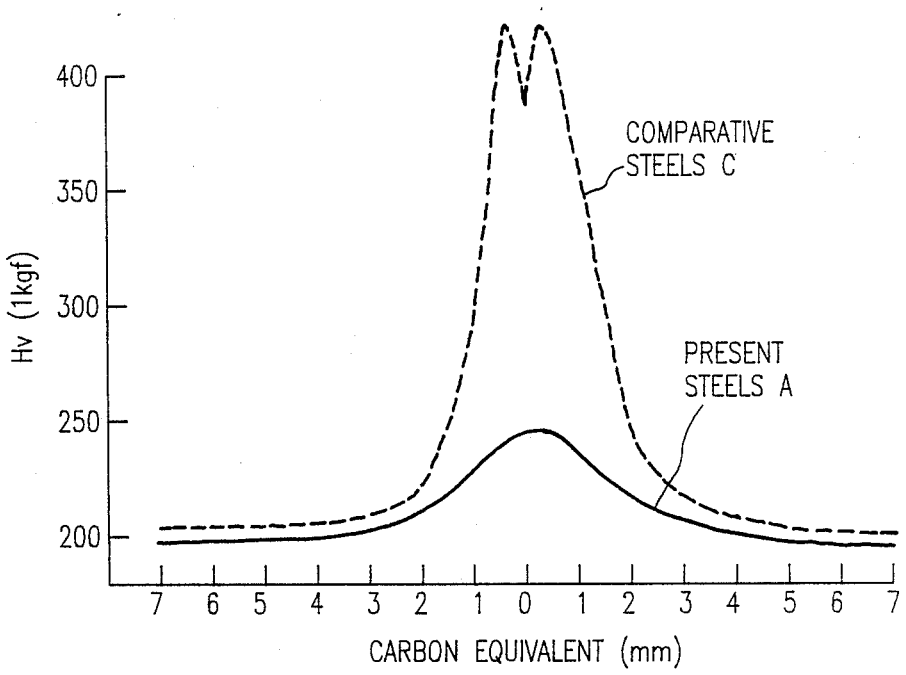
FIG. 3 is a graph showing an example of hardness distribution in the weld zone of steels of the present invention and comparative steels.

Each of the thus treated steel sheets was DC butt welded and formed into a wheel rim in a wheel rim production line, and the rejection ratio of the product was measured. The results are shown in Table 2. It is seen from the table that with the Present Steels, the rejection ratio is extremely low. FIG. 3 shows the hardness distribution, and it shows that with the Present Steel, the maximum hardness of the weld zone is maintained to be low.

EXAMPLE 3

Figure 6:
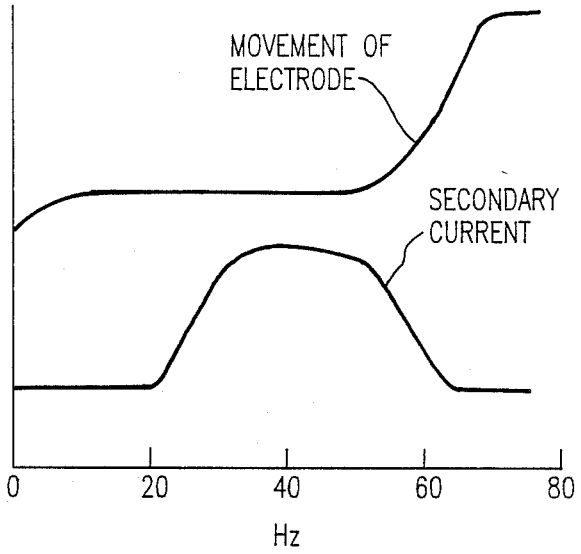
FIG. 6 is a graph showing DC but welding conditions in the Examples.

Steels having the chemical compositions given in Table 1 were melted, and slabs having a thickness of 220 mm were produced by continuous casing or ingot casting. Then, the slabs were formed into steel sheets having a thickness of 2.6 mm by the usual rolling method, followed by coiling at a temperature of 400 to 650° C. The coils were slitted after skin pass and pickling, and DC butt welding was conducted under the welding conditions shown in FIG. 6, followed by forming into wheel rims.

Figure 4:
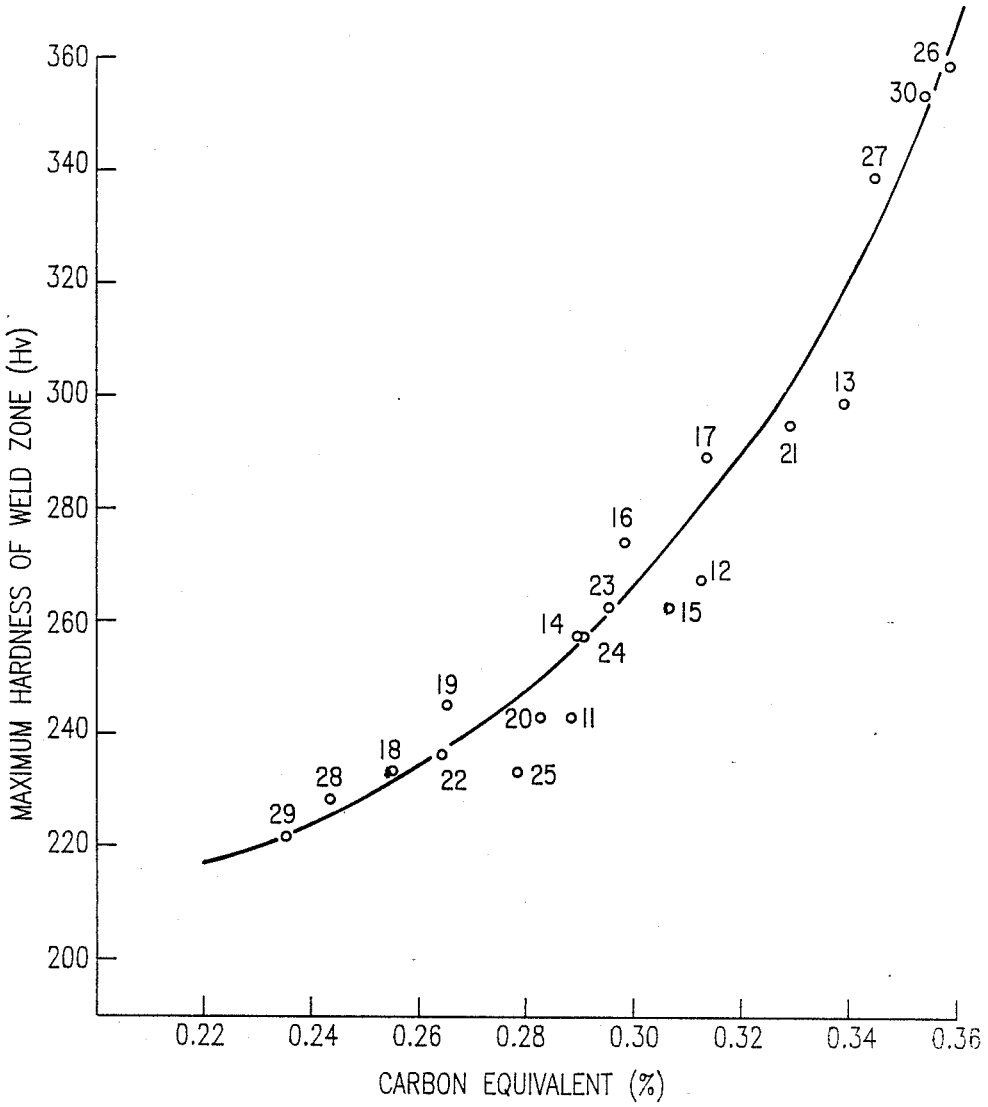

The mechanical properties of the hot rolled steeel sheets thus obtained and the rejection ratio in forming the wheel rims are shown in Table 3. The relationship between the carbon equivalent (Ceq) of the steels and the maximum hardness of the weld zone is shown in FIG. 4, in which the numbers indicate the

TABLE 1

| Steels | Chemical composition (% by weight) C | Si | Mn | P | S | Al | Nb | Ti | Ca | N* | REM | Ceq (%) | Mechanical properties YS (kgf/mm²) | TS (kgf/mm²) | Properties of weld zone Max. hardness (Hv) | $vE_O$ (kgf · m) |
|---|---|---|---|---|---|---|---|---|---|---|---|---|---|---|---|---|
| Present steels | | | | | | | | | | | | | | | | |
| 1 | 0.10 | 0.15 | 1.35 | 0.020 | 0.002 | 0.028 | — | 0.012 | — | 55 | — | 0.34 | 42.0 | 56.4 | 245 | 2.4 |
| 2 | 0.14 | 0.13 | 1.50 | 0.017 | 0.003 | 0.030 | — | 0.015 | — | 48 | — | 0.40 | 45.2 | 60.8 | 260 | 2.3 |
| 3 | 0.06 | 0.14 | 1.30 | 0.018 | 0.004 | 0.025 | 0.035 | 0.014 | — | 40 | — | 0.29 | 47.8 | 58.3 | 225 | 2.5 |
| 4 | 0.10 | 0.18 | 1.38 | 0.021 | 0.002 | 0.035 | 0.038 | 0.012 | — | 28 | — | 0.34 | 51.6 | 62.5 | 240 | 2.3 |
| 5 | 0.09 | 0.30 | 1.45 | 0.018 | 0.005 | 0.029 | — | 0.020 | 0.003 | 30 | — | 0.34 | 48.8 | 63.0 | 240 | 2.3 |
| 6 | 0.13 | 0.20 | 1.30 | 0.022 | 0.002 | 0.027 | — | 0.009 | — | 42 | 0.008 | .36 | 45.5 | 57.4 | 250 | 2.4 |
| 7 | 0.09 | 0.12 | 1.39 | 0.014 | 0.003 | 0.030 | 0.030 | 0.012 | 0.002 | 53 | — | 0.33 | 52.3 | 62.1 | 235 | 2.5 |
| 8 | 0.06 | 0.12 | 1.03 | 0.025 | 0.002 | 0.028 | 0.018 | 0.009 | — | 45 | 0.007 | 0.24 | 46.7 | 56.4 | 210 | 2.6 |
| Comparative steels | | | | | | | | | | | | | | | | |
| a | 0.04 | 0.05 | 0.85 | 0.021 | 0.002 | 0.030 | 0.020 | — | — | 35 | — | 0.18 | 45.2 | 55.8 | 280 | 1.8 |
| b | 0.19 | 0.30 | 1.52 | 0.016 | 0.001 | 0.025 | — | — | — | 40 | — | 0.46 | 44.9 | 60.6 | 440 | 0.2 |
| c | 0.08 | 0.15 | 1.32 | 0.019 | 0.002 | 0.030 | 0.040 | — | — | 23 | — | 0.31 | 52.0 | 62.2 | 350 | 0.8 |
| d | 0.10 | 0.20 | 1.38 | 0.020 | 0.004 | 0.028 | 0.035 | 0.042 | — | 29 | — | 0.34 | 52.1 | 65.9 | 375 | 0.5 |
| e | 0.04 | 0.32 | 1.09 | 0.022 | 0.003 | 0.030 | 0.070 | — | — | 33 | — | 0.23 | 52.8 | 62.0 | 300 | 1.4 |

Note
*The unit of the amount of N is ppm.

TABLE 2

| Steels | | Chemical composition (% by weight) C | Si | Mn | P | S | Al | Nb | Ti | N | O | Mechanical properties YS (kgf/mm²) | TS (kgf/mm²) | Elongation (%) | Rejection ratio (%) |
|---|---|---|---|---|---|---|---|---|---|---|---|---|---|---|---|
| Present steels | A | 0.08 | 0.15 | 1.35 | 0.020 | 0.002 | 0.035 | 0.035 | 0.012 | 0.0038 | 0.0020 | 42.9 | 61.4 | 27.2 | 0.8 |
| | B | 0.12 | 0.30 | 1.35 | 0.018 | 0.003 | 0.033 | 0.015 | 0.012 | 0.0045 | 0.0018 | 50.1 | 60.8 | 27.5 | 1.1 |
| Comparative steels | C | 0.10 | 0.07 | 1.45 | 0.018 | 0.002 | 0.030 | 0.042 | — | 0.0035 | 0.0025 | 52.2 | 62.0 | 26.9 | 12.1 |
| | D | 0.08 | 0.05 | 1.42 | 0.020 | 0.003 | 0.028 | 0.030 | 0.045 | 0.0029 | 0.0019 | 54.5 | 62.8 | 26.0 | 23.5 |

TABLE 3

| Steels | | Chemical composition (% by weight) C | Si | Mn | P | S | Al | Nb | Ti | Ca | REM | Ceq (%) | Mechanical properties YS (kgf/mm²) | TS (kgf/mm²) | Elongation (%) | Maximum hardness of weld zone (Hv) | Rejection ratio in forming wheel rim (%) |
|---|---|---|---|---|---|---|---|---|---|---|---|---|---|---|---|---|---|
| Pre- | 11 | 0.06 | 0.11 | 1.34 | 0.015 | 0.004 | 0.036 | 0.043 | — | | — | 0.288 | 53.2 | 60.2 | 26.5 | 240 | 0 |

TABLE 3-continued

Figure 5:
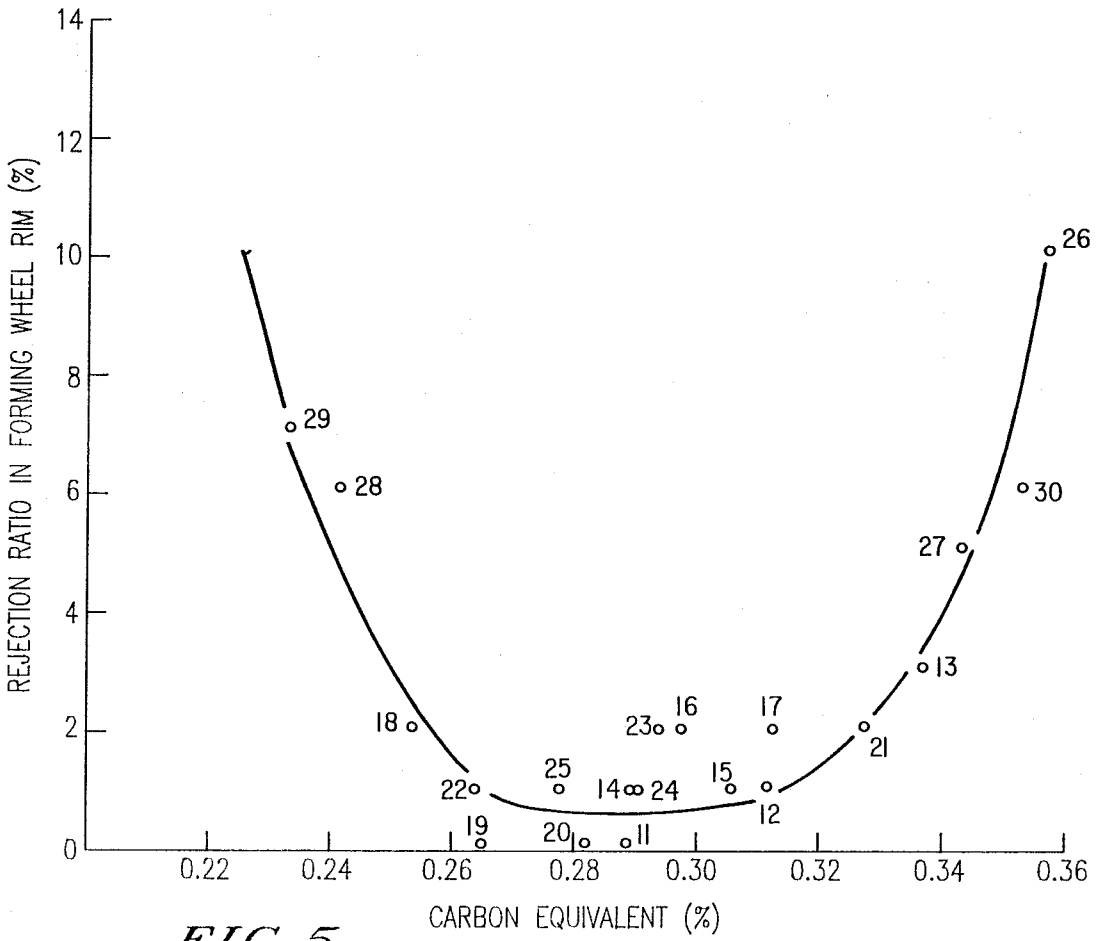
FIG. 5 is a graph showing the relationship between carbon equivalent and rejection ratio in forming wheel rims, for steels of the present invention and comparative steels.

| Steels | | Chemical composition (% by weight) C | Si | Mn | P | S | Al | Nb | Ti | Ca | REM | Ceq (%) | Mechanical properties YS (kgf/mm²) | TS (kgf/mm²) | Elongation (%) | Maximum hardness of weld zone (Hv) | Rejection ratio in forming wheel rim (%) |
|---|---|---|---|---|---|---|---|---|---|---|---|---|---|---|---|---|---|
| sent | 12 | 0.08 | 0.16 | 1.35 | 0.022 | 0.003 | 0.034 | 0.035 | — | | — | 0.312 | 52.4 | 61.0 | 26.0 | 265 | 1 |
| steels | 13 | 0.09 | 0.16 | 1.39 | 0.019 | 0.004 | 0.031 | 0.032 | — | | — | 0.338 | 50.3 | 60.7 | 27.0 | 298 | 3 |
| | 14 | 0.07 | 0.06 | 1.30 | 0.020 | 0.003 | 0.030 | — | 0.052 | | — | 0.289 | 53.4 | 61.4 | 24.5 | 255 | 1 |
| | 15 | 0.08 | 0.10 | 1.33 | 0.018 | 0.003 | 0.035 | 0.015 | 0.037 | | — | 0.306 | 51.3 | 60.5 | 26.5 | 260 | 1 |
| | 16 | 0.06 | 0.20 | 1.38 | 0.025 | 0.003 | 0.037 | 0.050 | — | Ca :0.0025 | | 0.298 | 52.7 | 61.1 | 24.5 | 272 | 2 |
| | 17 | 0.09 | 0.07 | 1.32 | 0.023 | 0.004 | 0.034 | — | 0.050 | | REM:0.008 | 0.313 | 54.2 | 62.3 | 23.5 | 288 | 2 |
| | 18 | 0.04 | 0.15 | 1.25 | 0.022 | 0.004 | 0.035 | 0.035 | — | | — | 0.255 | 48.9 | 56.2 | 26.5 | 230 | 2 |
| | 19 | 0.06 | 0.11 | 1.20 | 0.018 | 0.003 | 0.028 | 0.027 | — | | — | 0.265 | 47.0 | 55.9 | 28.0 | 242 | 0 |
| | 20 | 0.09 | 0.13 | 1.12 | 0.025 | 0.003 | 0.031 | 0.018 | — | | — | 0.282 | 46.7 | 56.8 | 29.5 | 240 | 0 |
| | 21 | 0.10 | 0.08 | 1.35 | 0.024 | 0.003 | 0.025 | 0.011 | — | | — | 0.328 | 47.9 | 55.4 | 30.0 | 294 | 2 |
| | 22 | 0.10 | 0.25 | 0.92 | 0.020 | 0.004 | 0.027 | — | 0.042 | | — | 0.264 | 50.4 | 57.1 | 27.0 | 233 | 1 |
| | 23 | 0.07 | 0.20 | 1.30 | 0.027 | 0.003 | 0.033 | 0.015 | 0.037 | | — | 0.295 | 47.8 | 56.2 | 28.5 | 260 | 2 |
| | 24 | 0.07 | 0.12 | 1.29 | 0.017 | 0.004 | 0.038 | 0.025 | — | Ca :0.0025 | | 0.290 | 47.3 | 55.7 | 28.0 | 255 | 1 |
| | 25 | 0.05 | 0.06 | 1.35 | 0.028 | 0.004 | 0.030 | 0.035 | — | | REM:0.012 | 0.278 | 49.3 | 56.0 | 27.5 | 230 | 1 |
| Com- | 26 | 0.11 | 0.16 | 1.46 | 0.017 | 0.004 | 0.034 | 0.030 | — | | — | 0.358 | 49.2 | 61.6 | 26.5 | 360 | 10 |
| para- | 27 | 0.11 | 0.35 | 1.33 | 0.018 | 0.004 | 0.035 | 0.015 | — | | — | 0.344 | 48.1 | 60.2 | 27.0 | 330 | 5 |
| tive | 28 | 0.06 | 0.24 | 1.04 | 0.016 | 0.003 | 0.041 | 0.050 | 0.040 | | — | 0.243 | 56.2 | 62.3 | 22.5 | 225 | 6 |
| steels | 29 | 0.07 | 0.17 | 0.95 | 0.023 | 0.004 | 0.029 | — | 0.072 | | — | 0.235 | 51.8 | 57.5 | 23.5 | 218 | 7 |
| | 30 | 0.11 | 0.06 | 1.45 | 0.020 | 0.003 | 0.031 | — | 0.050 | Ca :0.015 | | 0.354 | 49.5 | 56.5 | 28.0 | 355 | 6 |

steel numbers (the same applies to FIG. 5). It is seen from the figure that the maximum hardness increases with Ceq, and exceeds Hv 300 when Ceq exceeds 0.34%.

FIG. 5 shows the relationship between Ceq and the rejection ratio in forming the wheel rims. Where Ceq is in the range of 0.25 to 0.34%, the rejection ratio is maintained to be not higher than 3%, but when Ceq exceeds 0.34%, the rejection ratio increases sharply. The cause of the defect is mainly the cracking starting from the welded part during a flaring step which is the first step in forming a wheel rim. On the other hand, where Ceq is less than 0.28%, the rejection ratio is again high. In this case, the defect is a reduction in the material thickness at the portion affected by the welding heat or at a strongly worked portion, the cause thereof being insufficient total elongation.

What is claimed is:

1. A high strength hot rolled steel sheet for wheel rims, consisting of, by weight, from 0.05–0.15% of C, from 0.05–0.5% of Si, from 1.0–1.6% of Mn, from 0.01–0.05% of Al, from 0.005–0.025% of Ti and from 15–60 ppm of N, with the content of P limited to 0.030% or below and the content of S limited to 0.010% or below, the balance being iron and unavoidable impurities, and wherein the carbon equivalent Ceq=C+Si/24+Mn/6 is in the range of from 0.25–0.34%.

2. A high strength hot rolled steel sheet for wheel rims, consisting of, by weight, from 0.05 to 0.15% of C, from 0.05 to 0.5% of Si, from 1.0 to 1.6% of Mn, from 0.01 to 0.05% of Al, from 0.005 to 0.025% of Ti, from 0.01 to 0.06% of Nb and from 15 to 60 ppm of N, with the content of P limited to 0.030% or below and the content of S limited to 0.010% or below, the balance being iron and unavoidable impurities, and wherein the carbon equivalent Ceq=C+Si/24+Mn/6 is in the range of from 0.25–0.34%.

3. A high strength hot rolled steel sheet for wheel rims, consisting of, by weight, (a) from 0.05 to 0.15% of C, from 0.05 to 0.5% of Si, from 1.0 to 1.6% of Mn, from 0.01 to 0.05% of Al, from 0.005 to 0.025% of Ti, from 15 to 60 ppm of N, and (b) at least one member selected from the group consisting of 0.0005 to 0.01% of Ca and 0.005 to 0.1% of rare earth metals, with the content of P limited to 0.030% or below and the content of S limited to 0.010% or below, the balance being iron and unavoidable impurities, and wherein the carbon equivalent Ceq=C+Si/24+Mn/6 is in the range of from 0.25–0.34%.

* * * * *